US008628628B1

(12) United States Patent
Bonner et al.

(10) Patent No.: US 8,628,628 B1
(45) Date of Patent: Jan. 14, 2014

(54) AUTO-CLEAN HEAT EXCHANGER DEEP CLEANING STATION

(76) Inventors: Michael R. Bonner, Rochester Hills, MI (US); Gregory D. Kremer, Livonia, MI (US); C. Robert Gladstone, Royal Oak, MI (US)

( * ) Notice: Subject to any disclaimer, the term of this patent is extended or adjusted under 35 U.S.C. 154(b) by 499 days.

(21) Appl. No.: 12/849,594

(22) Filed: Aug. 3, 2010

Related U.S. Application Data

(60) Provisional application No. 61/230,990, filed on Aug. 3, 2009.

(51) Int. Cl.
*B08B 9/00* (2006.01)

(52) U.S. Cl.
USPC ..... 134/166 R; 134/168 R

(58) Field of Classification Search
USPC ..... 134/166 R, 168 R, 169 A
See application file for complete search history.

(56) References Cited

U.S. PATENT DOCUMENTS 1,799,105 A * 3/1931 Lasko ..... 134/168 R
2,222,516 A * 11/1940 Powell et al. ..... 134/10
3,457,108 A * 7/1969 Hittel ..... 134/22.1
4,058,412 A * 11/1977 Knapp et al. ..... 134/24
4,420,994 A * 12/1983 Muller et al. ..... 477/129
5,021,096 A * 6/1991 Abadi ..... 134/22.14
5,159,956 A * 11/1992 Kurihara ..... 137/624.13
5,764,717 A * 6/1998 Rootham ..... 376/316
6,178,925 B1 * 1/2001 Sturm et al. ..... 122/390
8,114,222 B2 * 2/2012 Fernholz et al. ..... 134/28

FOREIGN PATENT DOCUMENTS

JP 2000-210541 * 8/2000
SU 568394 * 4/1979
SU 1230707 * 5/1986

* cited by examiner

*Primary Examiner* — Jason Ko
(74) *Attorney, Agent, or Firm* — Young Basile

(57) ABSTRACT

This free-standing unit allows heat exchangers to be deep cleaned either in place or off line. Cleaning is performed by circulating cleaning solution at high velocity from an on-board reservoir through the heat exchanger and automatically reversing the direction of flow through the heat exchanger back and forth at a user selectable rate. Regardless of the direction of flow through the heat exchanger, the cleaning fluid is always routed back to the reservoir through a filter assembly to remove any debris flushed from the heat exchanger.

11 Claims, 3 Drawing Sheets

AUTO-CLEAN HEAT EXCHANGER DEEP CLEANING STATION

BACKGROUND

The present invention is directed to heat exchanger cleaning devices. Since the invention of the heat exchanger, they have been plagued by contamination problems that require the unit to be cleaned. Some designs allow disassembly for manual cleaning, while others are sealed. Many critical processes (food, dairy, pharmaceutical, petroleum, paint, etc.) require that the system be sealed and that all components in the system be designed for "clean-in-place" to prevent or minimize contamination. Still, there are times when the design of heat exchangers must balance between size and configuration of exposed material contact surfaces (to optimize thermal transfer area) and cleanability. Most manufacturers recommend that heat exchange units be cleaned thoroughly and regularly to prevent fouling and system contamination. The ability to clean the unit without disassembly minimizes disturbance to gaskets and seals that can result in leakage and reduces the chance for system contamination.

Many systems have been designed to clean heat exchangers, both off line (after the heat exchanger is removed from the host system), or in place. Some are comprised of a tank from which a cleaning solution is pumped through the heat exchanger to "flush out" any impurities. Often these are used to "back flush" the unit, where the connection of the circulation system causes the flow of the cleaning solution to be opposite that of the normal fluid flow through the heat exchanger. Back flush operations can require repiping to achieve the altered flow directions. The flushing fluid may be an aqueous material, organic solvent-based systems, or fluid that combines the two.

Still another commercially available solution is to use a mixture of solvent and air to create turbulence in the heat exchangers typically in the standard flow direction. While this does create turbulence and a "scrubbing effect," the mixture of air and solvent is less dense than the cleaning solution alone and therefore has less force behind it. These systems may be piped to "back flush" the unit, but manual repiping is required to change the direction of flow, and this can be a slow and laborious process that does not create the immediate disturbance necessary to dislodge trapped particles. Yet another disadvantage of this type of system is that, if a volatile solvent is used, the mixture of air and solvent comprises two of the three legs of the fire triangle and only an ignition source (in many cases, just a spark) is necessary to create catastrophe.

SUMMARY

The system disclosed herein is an auto-clean heat exchanger deep cleaning station that is a free-standing unit that allows heat exchangers to be deep cleaned either in place or off line. The device includes an on-board reservoir configured to contain and dispense at least one cleaning fluid, means for conveying at least a portion of the cleaning fluid into contact with a heat exchange unit, means for alternating the direction of cleaning fluid flow through the heat exchanger at least one alternating rate and means for conveying cleaning fluid back to the reservoir upon completion of a cleaning cycle.

Also disclosed is a method for cleaning a heat exchange unit that includes the steps of releasably connecting a heat exchanger cleaning device to an associated heat exchange unit, introducing high velocity fluid into the heat exchange unit from the cleaning device in a first fluid flow direction; allowing the introduced fluid to flow through the heat exchange unit for an interval; reversing the fluid flow to a second direction; and returning and removing the cleaning fluid from the heat exchanger.

Cleaning is performed by circulating cleaning solution(s) at high velocity from an on-board reservoir through the heat exchanger and automatically reversing the direction of flow through the heat exchanger back and forth at a user selectable rate. Regardless of the direction of flow through the heat exchanger, the cleaning fluid is always routed back to the reservoir through a filter assembly to remove any debris flushed from the heat exchanger.

The various features, advantages and other uses of the present apparatus will become more apparent by referring to the following detailed description and drawing in which:

DETAILED DESCRIPTION

The device disclosed herein, which may be referred to as an Auto-Clean Heat Exchanger Deep Cleaning Station and is a free-standing unit that allows heat exchangers to be deep cleaned either in place or off line. It is contemplated that the capacity of the device may be varied and sized in order to provide the appropriate function for heat exchangers of varying capacity. It is also contemplated that the device may have suitable means to vary or adjust the volumes of cleaning fluid introduced into the associated heat exchanger in order to adapt to heat exchangers of differing capacities.

Figure 1A:
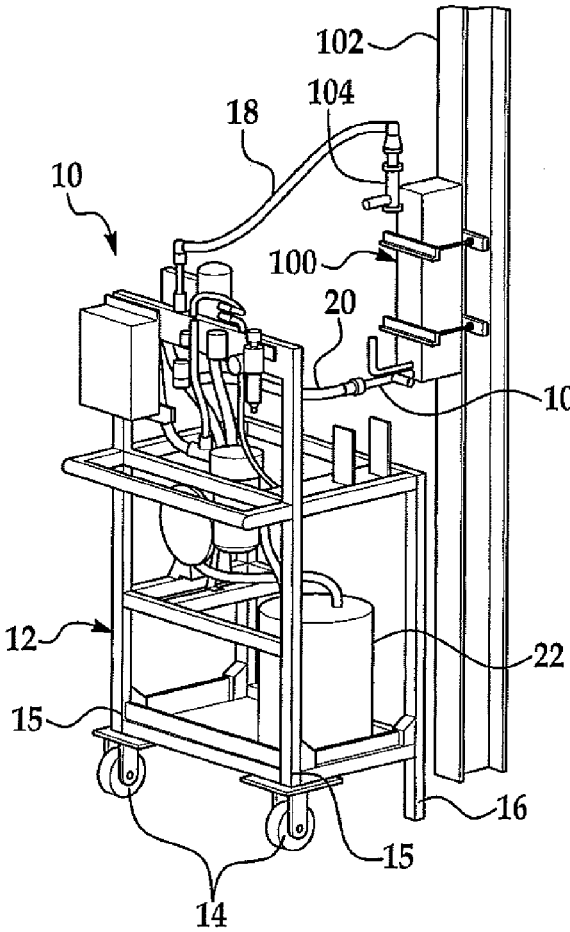
FIG. 1A and FIG. 1B are a front and back view of an embodiment of the device disclosed herein in the in-place operation mode with the associated heat exchanger still mounted in its production location.
Figure 1B:
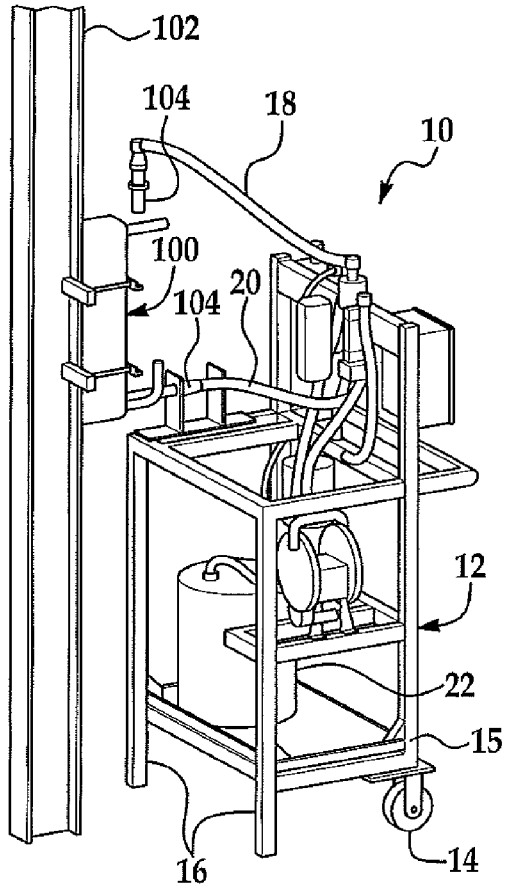
Figure 2A:
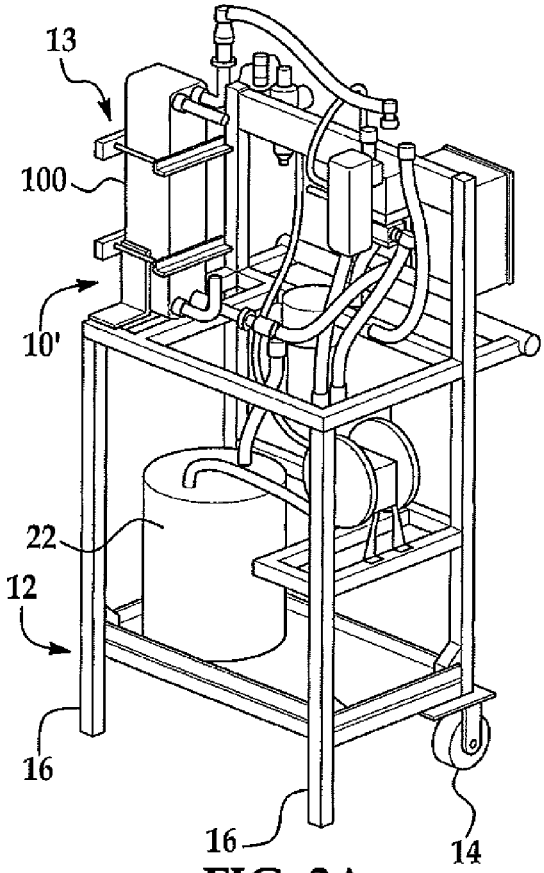
FIG. 2A and FIG. 2B are a front and back view of an embodiment of the device disclosed herein in the off-line operation mode with the associated heat exchanger a cradle located on the device as depicted.
Figure 2B:
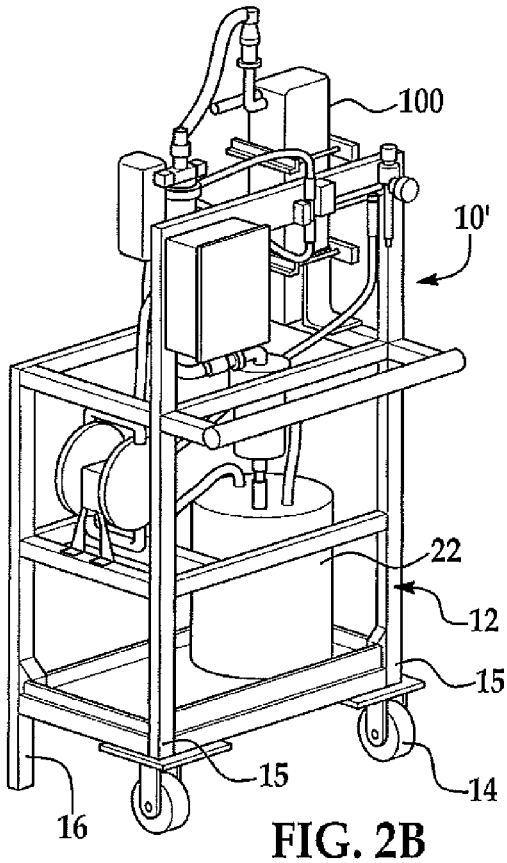

Broadly construed, the device disclosed herein includes a frame, at least one fluid reservoir mounted on the frame, at least one conduit connected to the reservoir configured to remove fluid from the reservoir and at least one conduit connected to the reservoir configured to reintroduce the removed fluid into the reservoir. The device also includes a means for introducing the removed fluid into an associated heat exchanger through at least two fluid introduction conduits releasably connectable to the associated heat exchanger, and a means for conveying fluid through the at least two fluid introduction conduits in an alternating intermittent manner.

Where desired or required, the heat exchanger cleaning device 10 can be employed to clean heat exchangers that have been removed from contact with the associated process device. It is also considered within the purview of this disclosure that the heat exchanger cleaning device 10 as disclosed herein can be used to clean heat exchangers in place; that is heat exchangers that remain in contact with the associated process device. A non-limiting embodiment of the heat exchanger cleaning device 10 suitable for use in an on-site cleaning operation is depicted in FIGS. 1A and 1B. A non-limiting embodiment of the heat exchanger cleaning device 10 suitable for use with detached heat exchangers is depicted in FIGS. 2A and 2B.

Broadly construed, the heat exchanger cleaning device 10, 10' can include a suitable housing or frame 12 configured to permit mounting attachment of the various elements of the device. The frame 12 may be configured to be transportable and, as such, may include suitable transport means. In the embodiment depicted in the various drawing figures, transport means can include suitable wheels 14 mounted to the bottom of the frame 12 as well as suitable stop devices to prevent travel or movement of the frame 12 when desired. In the embodiments depicted, wheels 14 are mounted at two bottom corner ends 15 of the frame 12 to permit pivotal movement when desired. In the embodiment as depicted, stop devices are opposed legs 16. It is also within the purview of this disclosure that the frame 12 be configured with four wheels 14 and be provided with suitable locking mechanisms.

When cleaning in place is desired, it is contemplated that the heat exchanger cleaning device 10 will be rolled into position adjacent to the fixed location of the heat exchanger to be cleaned, depicted as reference numeral 100 in the drawing figures. The heat exchanger 100 depicted as mounted to structure 102 is disconnected from its associated process circuit at coupling members 104 and is connected to the heat exchanger cleaning device 10 via the conduits 18, 20 provided. The conduits 18, 20 and associated heat exchanger 100 have suitable coupling devices to provide a fluid tight, pressure tight fit. Where desired or required, these couplers can be mating quick connect coupling fittings 19, 21.

The cleaning fluid can be conveyed to the heat exchanger 100 from a suitable cleaning fluid reservoir 22 via one of the suitable conduits 18, 20. The heat exchanger cleaning device 10 as disclosed herein will include means for introducing the cleaning fluid into the associated heat exchanger 100 in an alternating, intermittent manner. As used herein the term "alternating, intermittent manner" is defined as the introduction of cleaning fluid through the at least two conduits 18, 20 in a pattern in which introduction though the respective individual conduits is intermittent; when introduction through one conduit ceases, the introduction through the other conduit commences such that cleaning fluid is introduced into the heat exchanger 100 in an essentially continuous manner throughout the cleaning cycle interval.

In the embodiment depicted, the device 10 is equipped with two introduction conduits 18, 20. It is contemplated that the device 10 may have a greater number of conduits as needed for cleaning efficiency. However it is contemplated that the many such configurations, the multiple conduits will be paired with the associated conduit 18 or the associated conduit 20 to achieve cleaning fluid introduction in the manner outlined in this disclosure.

In various embodiments, it is contemplated that heat exchanger cleaning device 10 will be coupled with the associated heat exchanger 100 at fluid inlet and outlet ends respectively. Thus, as the cleaning fluid is introduced in an alternating intermittent fashion, it will travel inside the heat exchanger 100 in the direction of the operational fluid flow and in a counter-current direction depending upon the introduction conduit. It is also contemplated that the cleaning material can be introduced into either the water side or the process side on the associated heat exchanger 100 depending upon the given cleaning requirements of the associated heat exchanger 100.

The heat exchange cleaning device 10 also includes cleaning fluid removal conduits and mechanisms such that once the cleaning process is completed, the cleaning solution can be removed blown from contact with the heat exchanger 100 back into the cleaning fluid reservoir 22. The heat exchanger cleaning device 10 can then be disconnected from the heat exchanger 100 and the heat exchanger 100 can be reconnected to its associated process equipment. Where desired or required, quick-disconnects such as those depicted at reference numerals 19 and 21 can be incorporated into the heat exchanger 100 installation to facilitate this changeover.

It is contemplated that the heat exchanger cleaning device 10 as disclosed herein can be used to accomplish off-line cleaning of heat exchange units. One illustrative embodiment of this is depicted in FIGS. 2A and 2B. The device depicted therein can accomplish the same iteration of as the inline cleaning mode. Here, the heat exchanger 100 to be cleaned is removed from the associated process device (and is often replaced with a spare to minimize downtime of the associated process device). The removed heat exchanger 100 is taken to the heat exchanger cleaning device 10'. The heat exchanger cleaning device 10' can have a frame 12 equipped with a cradle 13 into which the heat exchanger 100 is mounted and the conduits 18, 20 are releasably connected to the side (process or water) of the heat exchanger 100 to be cleaned. In certain embodiments of the heat exchanger cleaning device 10 that is equipped with the heat exchanger cradle 13, it is contemplated that the length of the respective conduits 18, 20 may be reduced due to the proximity of the heat exchanger 100.

When the cleaning process is complete, the cleaning fluid is returned to the cleaning fluid reservoir 22 in the same fashion as described in the in-place application above. The heat exchanger 100 is then removed from the heat exchanger cleaning device 10 and is either stored or reconnected to its associated process device. Again, quick-disconnects can be incorporated into the heat exchanger 100 installation to facilitate this changeover.

Figure 3:
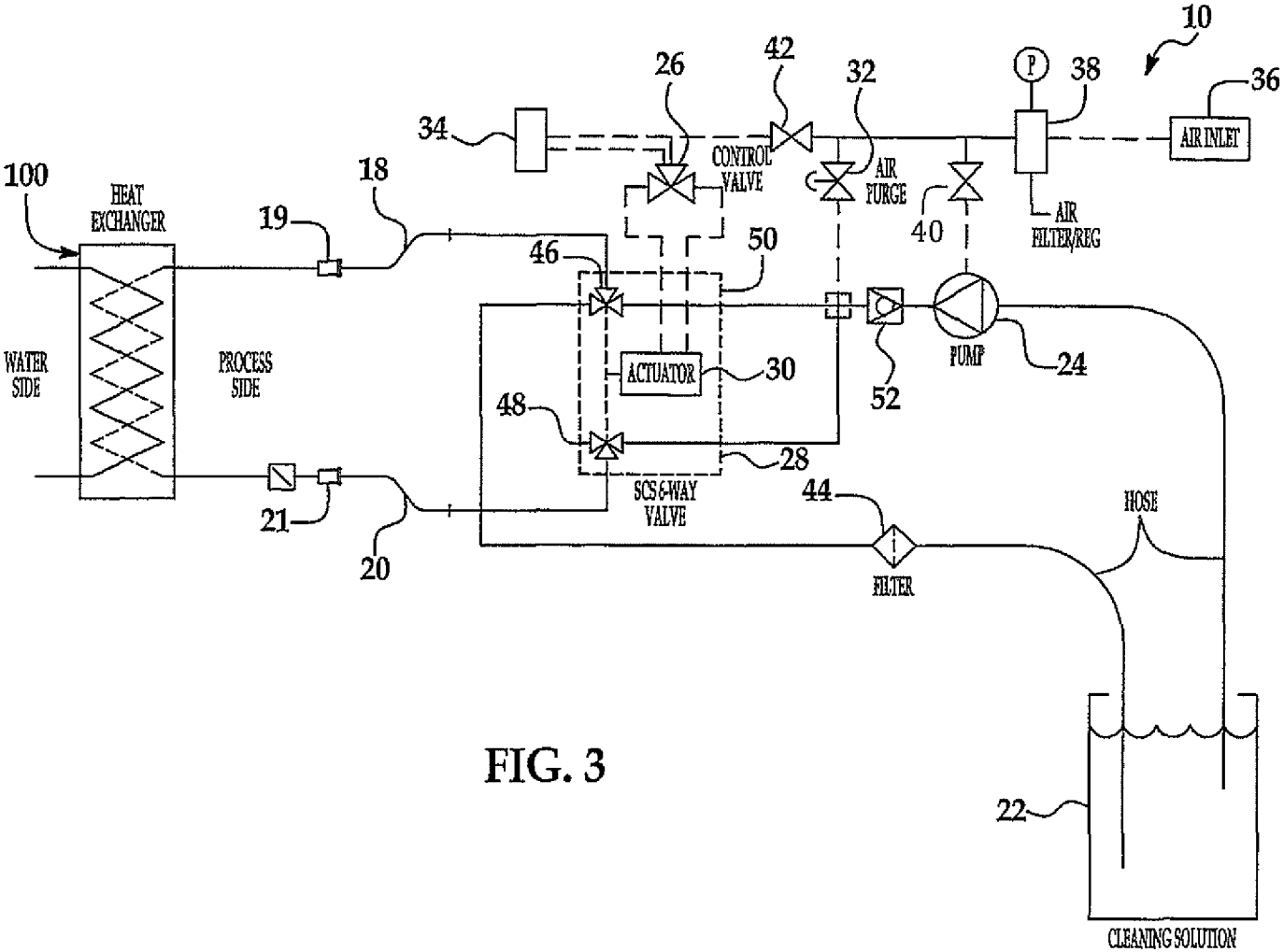
FIG. 3 is a schematic of an embodiment of the process and device disclosed herein showing the theory of operation.

The process will now be discussed in greater detail in reference to the schematic depicted in FIG. 3. The process schematic of the heat exchanger cleaning device 10 depicts and embodiment of the unique cleaning process and system disclosed herein. At the far left we see the heat exchanger 100 that is to be cleaned and that is connected to the heat exchanger cleaning device 10. In the diagram depicted in FIG. 3, the heat exchanger cleaning device 10 is shown as being connected to the process side of the heat exchanger 100. However, it is to be understood that the heat exchanger cleaning device 10 can be connected to either the process or the water (or other heat transfer fluid) side as desired or required for the cleaning operations contemplated. It is also contemplated that the heat exchanger cleaning device 10 can be configured with sufficient conduits to permit connection to both process and water sides simultaneously.

The heat exchanger cleaning device 10 includes at least one cleaning fluid reservoir 22. Where desired or required, it is considered within the purview of this disclosure that the heat exchanger cleaning device 10 can have multiple reservoirs to contain cleaning fluids of various compositions as desired or required.

The cleaning fluid reservoir 22 can be of any suitable size and volume of suitable capacity to deliver an effective volume of cleaning fluid to the associated heat exchanger 100. It is contemplated that a two to five gallon reservoir may be suitable for a wide variety of heat exchanger capacities and by virtue of its limited volume, naturally reduces the volume of cleaning solution (often a solvent) used for cleaning. In addition to the economic and environmental advantages of a small volume reservoir, the reduced weight also makes the unit easier to move.

Cleaning of the heat exchanger 100 is performed by circulating cleaning solution at high velocity from the cleaning fluid reservoir 22 through the heat exchanger 100 using a suitable pump 24 and routing system. The pump 24 is configured to provide adequate flow rate and pressure to convey the cleaning fluid through the heat exchanger 100 at a rapid rate and to be compatible with any of the various cleaning solutions to be employed by the end user. Non-limiting examples of suitable pump configurations include diaphragm, pumps, centrifugal pumps, lobe pumps, etc. Often, however, a diaphragm pump is used due to the continuous variation in the fluid flow created as result of the cleaning fluid delivery cycles. It is contemplated that the fluid delivery cycles which will be described in greater detail create a pulsing action that results in a scrubbing action sufficient to dislodge particulate material that may adhere to interior channels in the heat exchanger 100.

The heat exchanger cleaning device 10 as disclosed herein may be powered by any suitable power source. It is contemplated that, the heat exchanger 100 being cleaned is often located in an explosion-proof environment. In such situations, it is contemplated that all moving parts of the heat exchanger cleaning device 10 such as the pump 24, control valve(s) 26, at least one 6-way valve 28 and actuator 30, air purge valve 32, air timer 34, etc. are pneumatically operated. The compressed air can be obtained from any suitable on board or remote source. In the embodiment depicted in FIG. 3, the heat exchanger cleaning device 10 is coupled to a suitable source of shop air by means of a suitable coupling device associated with air inlet 36 and is conveyed into the heat exchanger cleaning device 10 through the air filter/regulator device(s) 38 configured to control and regulate the pressure and flow of the filtered air supply.

Pump speed can be controlled by a suitable controller configured to control pump speed for fluid flow in both directions. One non-limiting example of such controller is modulation of the series ball valve 40. In similar fashion, the air flow to the reversing system can control by modulating the series ball valve 42. Similarly, evacuation of the cleaning solution upon completion of the cleaning process can be accomplished by any suitable method. In the embodiment depicted, cleaning fluid removal from the heat exchanger 100 is accomplished by air purge and the cleaning solution air purge is controlled by modulating the manual air purge valve 32.

In the embodiment depicted, the flow control and reversing system includes the pneumatic SCS 6-way valve 28, air timer 34 and control valve 26 in pneumatic contact with the source of pressurized air. The piping on the pneumatic SCS 6-way valve 28 at drawing center selects the direction of the cleaning fluid flow through the heat exchanger 100, automatically cycling at a user selectable rate controlled by the adjustable air timer 34 through the control valve 26. As this diagram shows, regardless of the direction of cleaning fluid flow through the heat exchanger 100, the cleaning fluid is always routed back to the cleaning fluid reservoir 22 through the filter assembly 44 thereby removing any debris flushed from the heat exchanger 100 and keeping such materials from being reintroduced into the heat exchanger 100.

The 6-way valve 28 is comprised of two 3-way ball valves 46, 48 each connected to a single pneumatic actuator 30 through a gear box 50. When the actuator 30 is moved from one end to the other, the 3-way ball valves 46, 48 change flow between each of their selection ports. Because they are mechanically linked to the gear box 50, they move simultaneously; and because they are oriented to act opposite one another, they reverse the fluid flow through the heat exchanger 100. Because the supply from the pump 24 and the outlet to the filter assembly 44 are connected in parallel, the flow from the pump 24 to the filter assembly 44 is always in the same direction.

The change in flow direction through the heat exchanger 100 on each cycle of the air timer 34 creates significant turbulence and scrubbing action to clean debris and residues from the subject heat exchanger 100. Throughout the cleaning cycle, the adjustable air timer 34 triggers the control valve 26 to reverse the flow of air into the pneumatic actuator of the 6-way valve 28, thus causing the flow direction change as described. Suitable user interface such as controls on the air timer 34 allows the rate of the flow direction changes to be manually selected by the operator to optimize the cleaning cycle. It is contemplated that the user interface and controls can be programmed or otherwise configured with suitable limits that will permit interval adjustment with in a range that will minimize the risk of damage to the heat exchanger 100. This cycle rate range is limited in the system setup such that the cycle speed is sufficient to facilitate movement of debris from the heat exchanger 100 and entrapment in the filter unit. It is contemplated that the shortest cycle time will typically be longer than the "loop time" which is defined as the time that it takes for the pump 24 to move the cleaning fluid from the cleaning fluid reservoir 22 through the 6-way valve 28, through the heat exchanger 100, through the filter assembly 44 and back to the cleaning fluid reservoir 22. For effectiveness, this shortest cycle time should be double the loop time in most applications.

At the conclusion of a cleaning cycle, the cleaning solution in the system is purged from the components and transferred back to the cleaning fluid reservoir 22. This can be accomplished by actuating the manual air purge valve 32. This allows air to flow to the fluid inlet of the 6-way valve system 28 and forces the check valve 52 closed. If the pump 24 has not already been stopped by the operator via the series ball valve 40, this action will automatically stop the fluid motion. The compressed air will push the cleaning solution through the system and back to the cleaning fluid reservoir 22. The 6-way valve 28 is manually cycled via the air timer 34 to purge all lines in the heat exchanger cleaning device 10 and the heat exchanger 100. At this point the heat exchanger 100 being cleaned is both clean and empty and can be returned to service. This cleaning cycle may be repeated with multiple cleaning and conditioning fluids if desired.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed:

1. A heat exchanger cleaning device for treating a heat exchanger having a process side and a water side, the cleaning device comprising:

at least one cleaning fluid reservoir configured to contain a cleaning fluid;

at least one pump;

at least one removal conduit configured to remove fluid from the at least one cleaning fluid reservoir, the conduit in fluid communication between the at least one cleaning fluid reservoir and the at least one pump;

at least one reintroduction conduit configured to reintroduce the removed fluid into the at least one cleaning fluid reservoir, the reintroduction conduit distinct from the at least one removal conduit and in fluid communication with the at least one pump;

at least a first fluid introduction conduit and a second fluid introduction conduit, the first and second fluid introduction conduits releasably connectable to an associated heat exchanger at two separate generally opposed locations, the first and second fluid introduction conduits in fluid communication with the at least one pump; and a controller configured to introduce the cleaning fluid into the associated heat exchanger through the first and second fluid introduction conduits, wherein the cleaning fluid is introduced from the at least one cleaning fluid reservoir into the first and second fluid introduction conduits in an alternating intermittent manner such that the cleaning fluid travels through the first fluid introduction conduit in a first fluid flow direction and the cleaning fluid travels through the second fluid introduction conduit in a second fluid flow direction, wherein the cleaning fluid introduced into the associated heat exchanger from the first fluid introduction conduit travels through the associated heat exchanger in the first fluid flow direction and the cleaning fluid introduced from the second cleaning fluid introduction conduit travels in the second fluid flow direction opposed to the first fluid flow direction.

2. The device of claim 1 further comprising:

a frame, the frame having a lowermost region; and means for conveying the heat exchanger cleaning device, wherein the at least one cleaning fluid reservoir and the at least one pump are mounted on the frame and wherein the conveying means is positioned on a lowermost region of the frame.

3. The heat exchanger cleaning device of claim 1 wherein the first and second fluid introduction conduits are coupled to either the process side of the associated heat exchanger or the water side of the associated heat exchanger.

4. The heat exchanger cleaning device of claim 2 further comprising a heat exchanger mounting cradle connected to the frame, the heat exchanger mounting cradle configured to releasably receive the associated heat exchanger that has been detached from an associated process device.

5. The heat exchanger cleaning device of claim 1 wherein the at least one pump comprises at least on diaphragm, centrifugal or lobe pump.

6. The heat exchanger cleaning device of claim 1 wherein the controller further includes at least one pneumatic control, the at least one pneumatic control including at least one pneumatic control circuit having a 6-way control valve.

7. A heat exchanger cleaning device for treating a heat exchanger having a process side and a water side the cleaning device comprising:

at least one cleaning fluid reservoir containing a cleaning fluid;

at least one pump;

at least one removal conduit configured to remove fluid from the at least one cleaning fluid reservoir, the at least one removal conduit in fluid communication with the at least one pump;

at least one reintroduction conduit configured to reintroduce the removed fluid into the reservoir, the at least one reintroduction conduit in fluid communication with the at least one pump;

at least two fluid introduction conduits releasably connectable to an associated heat exchanger, the at least two fluid introduction conduits in fluid communication with the at least one pump; and means for introducing the cleaning fluid into the associated heat exchanger through the at least two fluid introduction conduits the cleaning fluid introduction means configured to introduce fluid into the conduits in an alternating intermittent manner, wherein the means for introducing the cleaning fluid into the associated heat exchanger through the at least two fluid introduction conduits in an alternating intermittent manner includes at least one pneumatic control, the at least one pneumatic control including at least one pump speed modulator, the at least one pump speed modulator comprising at least one series ball valve positioned in a pneumatic circuit associated with a first cleaning fluid flow direction and at least one series ball valve positioned in a pneumatic circuit associated with a second cleaning fluid flow direction.

8. The device of claim 7 wherein the means for introducing the cleaning fluid into the associated heat exchanger through the at least two fluid introduction conduits in an alternating intermittent manner includes at least one pneumatic circuit having a 6-way control valve.

9. The device of claim 8 wherein the 6-way valve comprises:

at least two 3-way ball valves;

at least one pneumatic actuator; and at least one gear box, wherein the at least one pneumatic actuator is configured to move from one end of the at least one gear box to the other and wherein the at least two 3-way valves are oriented opposite to one another and are mechanically linked to the at least one gear box such that they move simultaneously.

10. A method for cleaning a heat exchanger comprising the steps of:

attaching the heat exchanger cleaning device of claim 1 in releasable fluid contact with the associated heat exchanger such that the at least one removal or reintroduction conduit is in fluid contact with the fluid inlet end and the at least one removal or reintroduction conduit is in fluid contact with the fluid outlet end of at least one of the process side or the water side of the associated heat exchanger;

introducing the cleaning fluid contained in the cleaning fluid reservoir into the associated heat exchanger of the device of claim 1; and circulating the cleaning fluid through the associated heat exchanger, wherein the cleaning fluid flows through the associated heat exchanger sequentially in a first direction for a first interval and in a second opposed direction for a second interval.

11. The method of claim 10 wherein the cleaning fluid introduced into the associated heat exchanger at a first point flows through the associated heat exchanger in a first direction and the cleaning fluid introduced into the associated heat exchanger at a second point flows through the associated heat exchanger in a second direction opposed to the first direction.

* * * * *